US008776816B2

(12) United States Patent
Danziger

(10) Patent No.: US 8,776,816 B2
(45) **Date of Patent: *Jul. 15, 2014**

(54) PORTABLE ADJUSTABLE SHADE STRUCTURE

(75) Inventor: Warren L. Danziger, St. Louis, MO (US)

(73) Assignee: Paxdanz, LLC, St. Louis, MO (US)

( * ) Notice: Subject to any disclaimer, the term of this patent is extended or adjusted under 35 U.S.C. 154(b) by 147 days.

This patent is subject to a terminal disclaimer.

(21) Appl. No.: 12/768,149

(22) Filed: Apr. 27, 2010

(65) Prior Publication Data

US 2010/0243015 A1 Sep. 30, 2010

Related U.S. Application Data

(63) Continuation-in-part of application No. 12/157,756, filed on Jun. 13, 2008, now Pat. No. 7,703,469.

(51) Int. Cl.
*E04H 15/42* (2006.01)
*E04H 15/46* (2006.01)

(52) U.S. Cl.
USPC ..... 135/147; 135/139; 135/157

(58) Field of Classification Search
USPC ..... 135/135, 139, 140, 141, 142, 143, 144, 135/147, 157, 159
See application file for complete search history.

(56) References Cited

U.S. PATENT DOCUMENTS

| | | | |
|---|---|---|---|
| 684,130 | A | 10/1901 | Taubert |
| 1,326,006 | A | 12/1919 | Sterhardt |
| 1,493,915 | A | 5/1924 | Baker |
| 1,502,898 | A | 7/1924 | Berg |
| 1,666,757 | A | 4/1928 | Snyder |
| 1,712,836 | A | 5/1929 | Mills |
| 1,728,356 | A | 9/1929 | Morgan |
| 1,820,002 | A | 8/1931 | Forrester |
| 1,846,496 | A | 2/1932 | Mills |
| 1,853,367 | A | 4/1932 | Mace |
| 2,111,578 | A | 3/1938 | Weaver |
| 2,137,625 | A | 11/1938 | Norvell |
| 2,232,306 | A | 2/1941 | Baldwin |
| 2,764,993 | A | 10/1956 | Wallace et al. |
| 3,181,542 | A | 5/1965 | Baries |
| 3,199,518 | A | 8/1965 | Glidewell |
| 3,375,624 | A | 4/1968 | Mikulun |
| 3,496,687 | A | 2/1970 | Greenberg et al. |
| 4,006,768 | A | 2/1977 | Horgan, Jr. |
| 4,074,682 | A | 2/1978 | Yoon |

(Continued)

OTHER PUBLICATIONS

Written Opinion and International Search Report from co-pending patent Application No. PCT/US2009/003478.

(Continued)

*Primary Examiner* — David R Dunn
*Assistant Examiner* — Danielle Jackson
(74) *Attorney, Agent, or Firm* — Joseph M. Rolnicki; Evans & Dixon, LLC

(57) ABSTRACT

A canopy structure comprises a frame and a canopy. The frame comprises a plurality of arms and legs, where each of the arms extends outwardly from a hub to a leg, each arm and leg being joined by a leg connector. Preferably, each leg is telescopic and is lockable and the hub preferably comprises a releasable locking mechanism. The canopy structure further comprises a mechanism by which the canopy surface can be tilted to angles relative to the ground.

4 Claims, 20 Drawing Sheets

(56) References Cited

U.S. PATENT DOCUMENTS

| | | | | |
|---|---|---|---|---|
| 4,156,433 | A | 5/1979 | Beaulieu | |
| RE31,565 | E | 4/1984 | Beaulieu | |
| 4,607,656 | A | 8/1986 | Carter | |
| 4,641,676 | A | 2/1987 | Lynch | |
| 4,779,635 | A | 10/1988 | Lynch | |
| 4,835,918 | A | 6/1989 | Dippel | |
| 4,924,896 | A | 5/1990 | Carter | |
| 5,000,211 | A | 3/1991 | Speare et al. | |
| 5,020,559 | A | 6/1991 | Lai | |
| 5,035,253 | A | 7/1991 | Bortles | |
| 5,048,891 | A | 9/1991 | Yach | |
| RE33,710 | E | 10/1991 | Zeigler | |
| 5,121,765 | A | 6/1992 | MacMorris, Jr. | |
| 5,213,123 | A | 5/1993 | Whitfield | |
| 5,234,011 | A | 8/1993 | Lynch | |
| 5,339,847 | A | 8/1994 | Kanter et al. | |
| 5,390,685 | A | 2/1995 | McCoy | |
| 5,421,356 | A | 6/1995 | Lynch | |
| D365,884 | S | 1/1996 | Dennis | |
| 5,485,863 | A | 1/1996 | Carter | |
| 5,488,966 | A | 2/1996 | Baldwin et al. | |
| 5,490,533 | A | 2/1996 | Carter | |
| 5,511,572 | A | 4/1996 | Carter | |
| D377,822 | S | 2/1997 | Lichia | |
| 5,611,364 | A | 3/1997 | Woods et al. | |
| 5,632,292 | A | 5/1997 | Carter | |
| 5,632,293 | A | 5/1997 | Carter | |
| 5,752,537 | A | 5/1998 | Kranzler | |
| 5,802,778 | A | 9/1998 | Thorp et al. | |
| D403,782 | S | 1/1999 | James | |
| 5,884,646 | A | 3/1999 | Ju | |
| 5,921,260 | A | 7/1999 | Carter | |
| 5,930,971 | A | 8/1999 | Etheridge | |
| 5,934,301 | A | 8/1999 | Carter | |
| D418,611 | S | 1/2000 | Montague, III | |
| 6,035,874 | A | 3/2000 | Po-Chang | |
| 6,035,877 | A | 3/2000 | Losi, Jr. et al. | |
| 6,041,800 | A | 3/2000 | Carter | |
| 6,058,952 | A | 5/2000 | Lin et al. | |
| 6,076,312 | A | 6/2000 | Carter | |
| 6,089,245 | A | 7/2000 | Tseytlin et al. | |
| 6,089,247 | A * | 7/2000 | Price | 135/145 |
| 6,129,102 | A | 10/2000 | Carter | |
| 6,138,702 | A | 10/2000 | Carter | |
| 6,173,726 | B1 | 1/2001 | Talmadge | |
| 6,192,910 | B1 | 2/2001 | Carter | |
| 6,206,020 | B1 | 3/2001 | Lynch | |
| 6,216,717 | B1 | 4/2001 | Chen | |
| 6,230,729 | B1 | 5/2001 | Carter | |
| 6,240,940 | B1 | 6/2001 | Carter | |
| D445,916 | S | 7/2001 | Pritchard | |
| 6,302,124 | B1 | 10/2001 | Demarco | |
| 6,302,125 | B1 | 10/2001 | Lin et al. | |
| 6,357,461 | B1 | 3/2002 | Chai et al. | |
| 6,363,956 | B2 | 4/2002 | Carter | |
| 6,374,842 | B1 | 4/2002 | Carter | |
| 6,382,224 | B1 | 5/2002 | Carter | |
| 6,397,872 | B1 | 6/2002 | Carter | |
| 6,431,193 | B2 | 8/2002 | Carter | |
| 6,439,251 | B2 | 8/2002 | Carter | |
| 6,470,902 | B1 | 10/2002 | Carter | |
| 6,561,257 | B2 | 5/2003 | Huang | |
| 6,591,849 | B1 | 7/2003 | Swetish et al. | |
| 6,701,949 | B2 | 3/2004 | Carter | |
| 6,708,707 | B2 | 3/2004 | Dotterweich et al. | |
| 6,712,083 | B2 | 3/2004 | Carter | |
| 6,742,309 | B2 | 6/2004 | Stewart et al. | |
| 6,748,963 | B2 | 6/2004 | Carter | |
| 6,779,538 | B2 | 8/2004 | Morgante et al. | |
| 6,874,520 | B2 | 4/2005 | Carter | |
| 6,892,744 | B2 | 5/2005 | Feldpausch et al. | |
| 6,920,889 | B2 | 7/2005 | Carter | |
| 6,926,021 | B2 | 8/2005 | Carter | |
| 6,929,017 | B2 | 8/2005 | Byun | |
| 6,976,320 | B2 | 12/2005 | McClaskie | |
| 6,981,510 | B2 | 1/2006 | Carter | |
| 6,994,099 | B2 | 2/2006 | Goldwitz | |
| 7,025,074 | B2 | 4/2006 | Porter | |
| 7,044,083 | B2 | 5/2006 | Farmer et al. | |
| 7,044,146 | B2 | 5/2006 | Losi, Jr. | |
| 7,051,745 | B2 | 5/2006 | Carter | |
| 7,063,029 | B1 | 6/2006 | Tsui et al. | |
| D535,349 | S | 1/2007 | Shinner et al. | |
| 7,168,372 | B2 | 1/2007 | Fotia | |
| 7,168,439 | B2 | 1/2007 | Patel et al. | |
| 7,178,539 | B2 | 2/2007 | Patel et al. | |
| 7,178,541 | B2 | 2/2007 | Carter | |
| 7,178,542 | B2 | 2/2007 | Carter | |
| 7,350,532 | B2 * | 4/2008 | Wu | 135/144 |
| 7,703,469 | B2 | 4/2010 | Danziger | |
| 2002/0074031 | A1 | 6/2002 | Morgante et al. | |
| 2002/0170588 | A1 | 11/2002 | Seo | |
| 2003/0034061 | A1 | 2/2003 | Warner | |
| 2005/0241688 | A1 * | 11/2005 | Wu | 135/145 |
| 2007/0235069 | A1 * | 10/2007 | Martin | 135/117 |
| 2007/0283993 | A1 | 12/2007 | Carter | |

OTHER PUBLICATIONS

International Preliminary Examination Report from co-pending patent Application No. PCT/US2009/003478.

* cited by examiner

PORTABLE ADJUSTABLE SHADE STRUCTURE

PRIORITY CLAIM

This application is a Continuation-in-Part of co-pending U.S. patent application Ser. No. 12/157,756, filed Jun. 13, 2008, the entirety of which is hereby incorporated by reference. Patent Cooperation Treaty Application No. PCT/US2009/003478 was filed on Jun. 10, 2009 and claims priority to U.S. patent application Ser. No. 12/157,756, and the entirety of that PCT application is also hereby incorporated by reference.

FIELD OF THE INVENTION

The present invention relates generally to the field of portable canopies, specifically a lightweight, portable canopy that can be erected and collapsed by a single individual, and one that allows a tilting of the shading surface to angles relative to the ground.

BACKGROUND OF THE INVENTION

Many foldable and collapsible structures for providing shelter from the weather or elements are already commercially available. Most of these products provide a shelter with some sort of domed or pointed roof. Many of these structures are complex and cumbersome in construction.

A drawback to the commonly available portable structure is the massive size and weight of the main supporting structure, thereby making them heavy, cumbersome and generally difficult to transport, especially for a single individual. Many of the collapsible structures that are portable are not small enough to be practical for personal or small group use. Additionally, due to the weight and size, some canopies require multiple people for assembly.

A problem with conventional structures is the inability of the canopies to adapt or accommodate for different circumstances. For many of these structures, the main objective is covering from the elements like rain or wind, and as such, typically the structure has some sort of peak for providing runoff from rain or additional supports to provide stability from wind. The construction to accommodate these situations is reinforced so as to make them rigid and not easily adapted or angled to adjust for the movement of the sun in relation to the user. In order to remain protected from the sun, the user has to move under the structure or move the structure base for better placement of shade. The inability of these canopies to adapt can frustrate the end use of providing shade. In addition, the size and nature of these structures makes them less accessible for use at a beach or for small gatherings where users prefer to be relatively unencumbered by bulky or heavy materials.

Another problem with many conventional canopies is the inability or difficulty in raising and lowering one leg independently of the other legs while the canopy is deployed. This inability or difficulty renders the canopy particularly difficult not only to set up and to adjust by an individual acting alone, but also to adapt the canopy to ground that is not level.

Thus, it would be of great utility to have a portable canopy structure, one that is lightweight and sturdy, and can be erected and taken down by a single user, one that allows easy adjustment of individual canopy legs independently of the other legs, and one that would be capable of being adjusted so that the canopy can be made to adapt to the movement of the sun.

SUMMARY OF THE INVENTION

The present invention is a canopy structure comprising a frame and a canopy. The frame comprises a plurality of arms and legs, where each of the arms extends outwardly from a hub to a leg, each arm and leg being joined by a leg connector. Each leg comprises an upper section and a lower section, and each arm comprises an inner section and an outer section. Preferably, each leg is telescopic and is lockable, more preferably in at least two telescope configurations. The hub preferably comprises a releasable locking mechanism.

The present invention further comprises a mechanism by which the canopy surface can be tilted to angles relative to the ground.

In one embodiment, the user can change the angle of the top of the canopy by adjusting each of the leg connectors and further by adjusting the telescope configurations of at least one leg.

In another embodiment, the canopy further comprises a series of cross arms, whereby the cross arms are structures that begin at one leg, preferably below or just below the leg connector of that leg, at a cross arm connector and extend to an adjacent leg, ending preferably below or just below the leg connector of that adjacent leg at another cross arm connector. It is preferred that each leg is connected to each adjacent leg by at least one cross arm, such that the cross arms in aggregate essentially form a perimeter around the frame, when viewed from above. In this particular embodiment, the user can change the angle of the canopy by adjusting the telescope configuration of at least one leg.

BRIEF DESCRIPTION OF THE DRAWINGS

Numerous other objects, features and advantages of the present invention should now become apparent upon a reading of the following detailed description taken in conjunction with the accompanying drawings, in which.

Corresponding reference numbers indicate corresponding parts throughout the several views of the drawings.

DETAILED DESCRIPTION OF THE INVENTION

Figure 1:
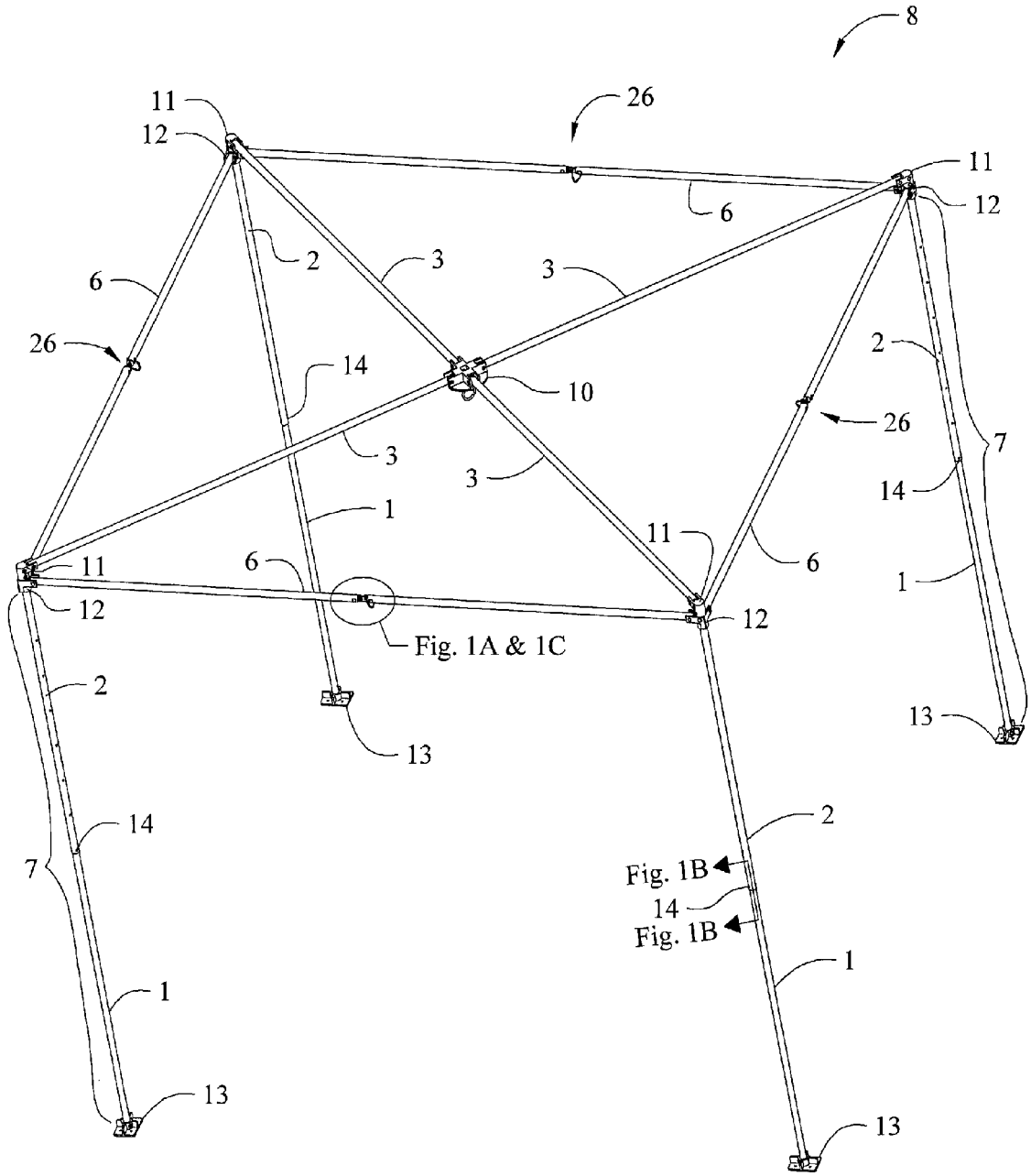
FIG. 1 is a perspective view of a fully erected embodiment of the frame of present invention.
Figure 12:
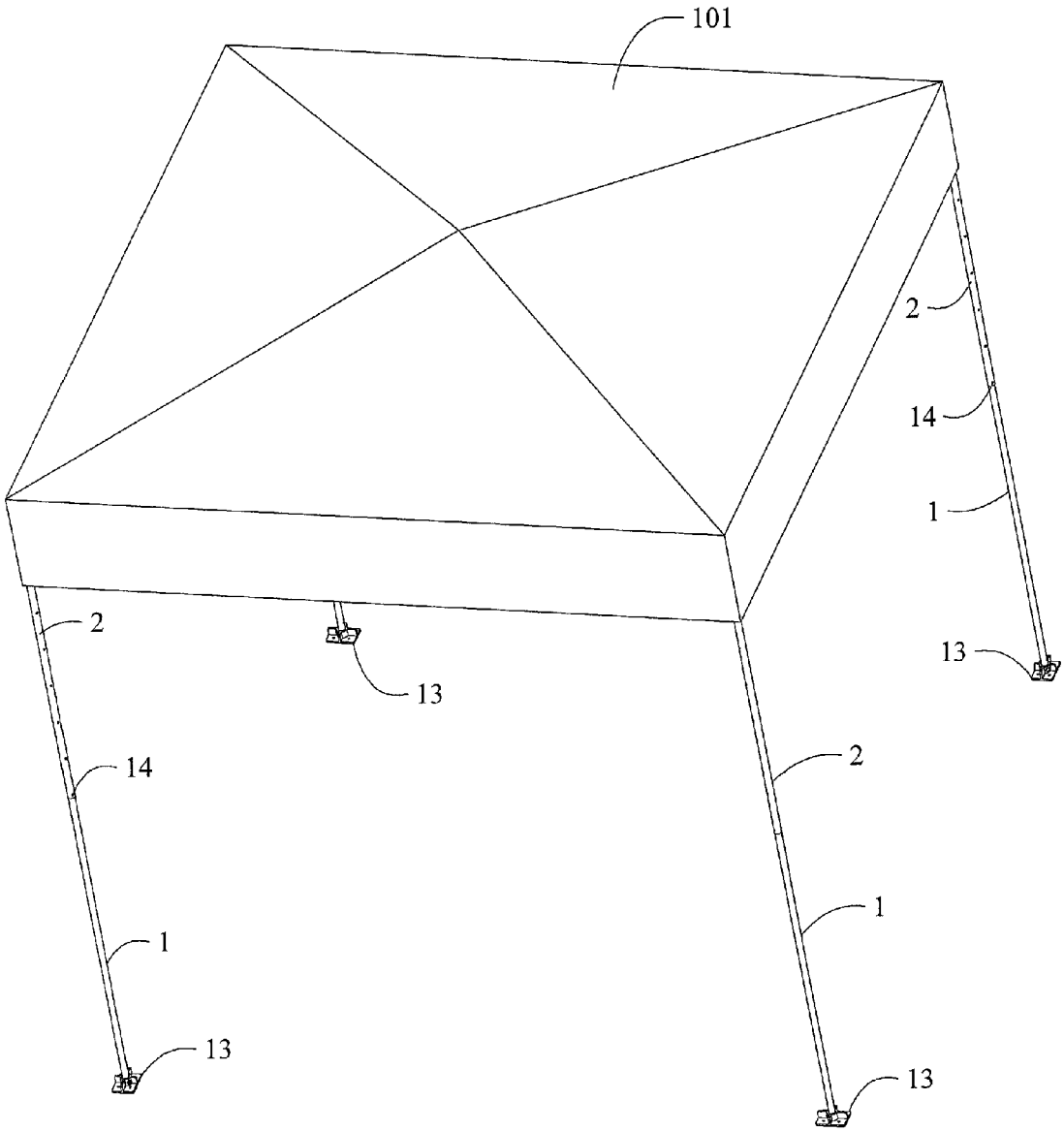
FIG. 12 is a perspective view of a fully erected embodiment of the portable adjustable shade structure of the present invention, showing a frame with a canopy attached thereto.

A canopy structure comprises a frame 8, as illustrated in FIG. 1, shrouded by a canopy 101, as illustrated in FIG. 12. As shown in FIG. 1, the frame 8 comprises a top of the frame and a plurality of legs 7 extending therefrom. More particularly, the plurality of legs 7 extend from corresponding leg connectors 11, a hub 10, and arms 3 extending radially outwardly from a hub such as the hub 10 to the leg connectors 11.

The top of the canopy frame 8, therefore, can be viewed as generally polygonal, where the leg connectors 11 thus may be construed as vertices that define a polygon. As shown in FIG. 1, the polygon is square or at least substantially square, although it should be understood that the polygon may be any type of polygon, preferably a convex polygon such as an elongate rectangle, but especially a regular polygon or at least a substantially regular polygon such as a regular or substantially regular triangle, pentagon, hexagon, or octagon. Accordingly, it is, preferred that the polygon be square or substantially square and so in a preferred embodiment the frame 8 comprises four legs 7, four arms 3, four leg connectors 11, and one hub 10. The frame 8 may further comprise a series of cross arms 6 extending between adjacent legs and connected thereto, preferably at or near the vertices by cross arm connectors 12, thus to form sides of the polygon defined by the vertices. It is preferred that the frame 8 further comprises, when cross arms are present, as many cross arms and cross arm connectors as there are legs 7. In a particularly preferred embodiment, the frame 8 comprises four arms 3, four legs 7, four cross arms 6, four leg connectors 11, four cross arm connectors 12 and one hub 10. In an embodiment, each leg 7 may extend from a leg connector 11 to a foot bracket 13, which may be a part of the leg 7 or secured to the leg by a fastener such as a rivet 17.

Each arm 3 comprises an inner section and an outer section, the inner section being oriented generally toward the hub 10 at the center portion of the top of the frame 8 and the outer section being oriented generally away from the hub 10 and toward the leg connector 11. Each leg 7 comprises an upper section 2 and a lower section 1, the upper section oriented generally toward the top portion of the frame 8 and the lower section oriented generally downwardly when the canopy structure is in an expanded state.

Preferably, each of the arms 3 extends from an inner end of the arm at the hub 10 to an outer end of the arm at the leg connector 11, such that the inner section of the arm 3 is oriented toward the inner end and the outer section of the arm 3 is oriented toward the outer end. The inner section, and preferably the inner end, of each of the arms 3 is pivotably connected to the hub 10, and the outer section, and preferably the outer end, of each of the arms 3 is pivotably connected to a respective leg connector 11. Each leg connector 11 further is in turn connected to the upper section 2 of a leg 7, and may be so connected either pivotably or rigidly. When present, a foot bracket 13 resides at the base of the lower section 1 of the leg 7.

Figure 10:
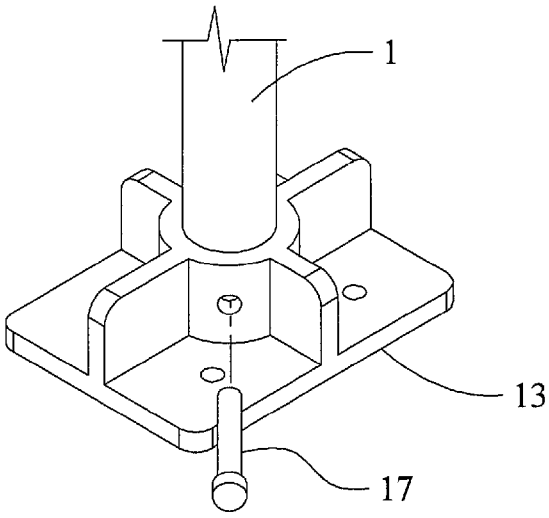
FIG. 10 is a detail perspective view of an embodiment of a foot bracket of the present invention.
Figure 10A:
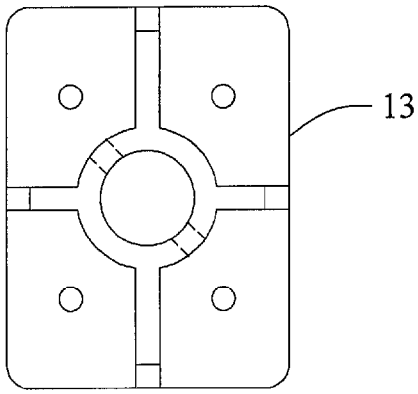
FIG. 10A is a detail top view of an embodiment of a foot bracket of the present invention.
Figure 10B:
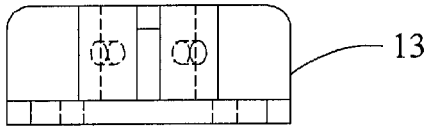
FIG. 10B is a cross-section side view of an embodiment of a foot bracket of the present invention.

FIGS. 10, 10A and 10B show a suitable embodiment of a foot bracket 13 for use in the present invention, with particular detail in FIG. 10 showing a suitable rivet 17 for securing the bracket to the lower section 1 of the leg 7.

As noted, in some embodiments, the frame 8 further comprises a series of cross arms 6. The cross arms extend from a cross arm connector 12 of one leg, residing below or preferably just below the leg connector 11 of that leg 7, to a cross arm connector 12 of an adjacent leg 7, residing preferably below or just below the leg connector 11 of that adjacent leg 7. It is preferred that each leg 7 is connected to each adjacent leg 7 by one cross arm 6, such that the cross arms in aggregate essentially form a perimeter around the canopy structure, when viewed from above. In another embodiment, where four legs 7 are present, there may be two cross arms 6 present, where the cross arms each connect two distinct legs 7, such that the two cross arms 6 are substantially parallel when the canopy structure is substantially erected. Preferably, the arms 3 are co-planar and each cross arm 6 is substantially parallel to the plane created by the arms 3 of the canopy structure when the canopy structure is fully erected.

Figure 3:
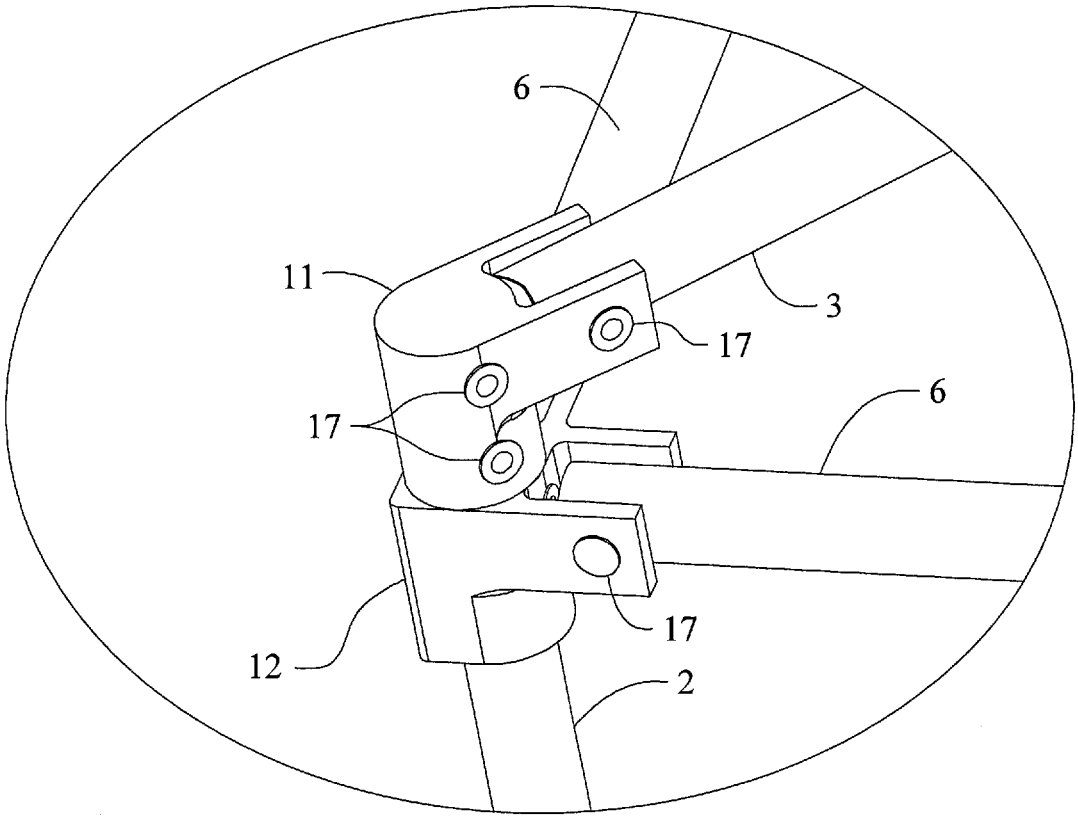
FIG. 3 is a detailed perspective view of an embodiment of a leg connector and an embodiment of a cross arm connector of the present invention.
Figure 9:
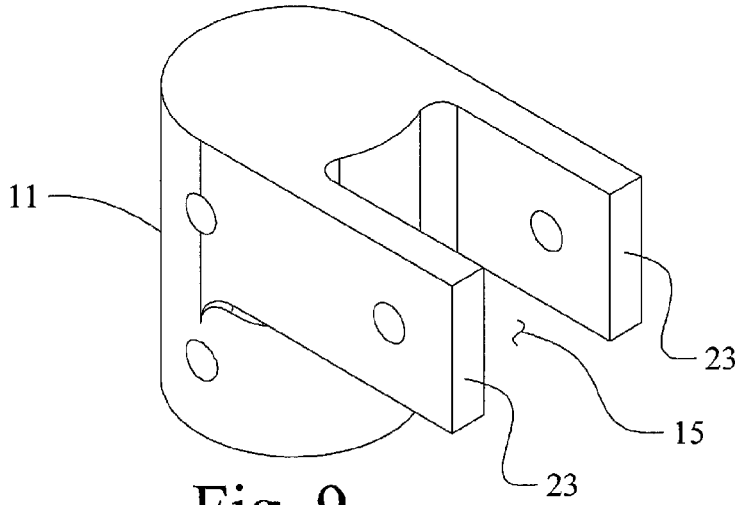
FIG. 9 is a detail perspective view of an embodiment of a leg connector of the present invention.
Figure 9A:
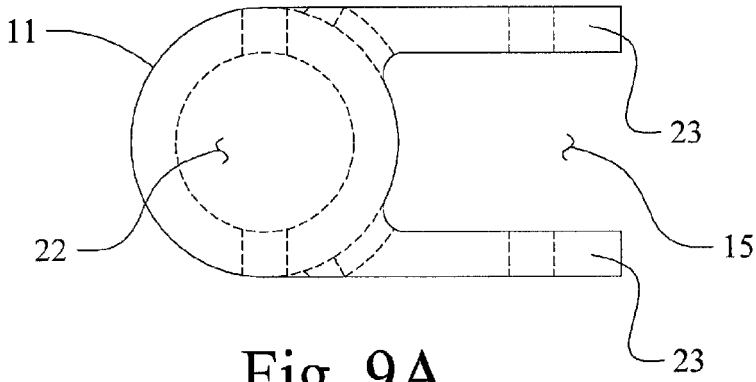
FIG. 9A is a detail top view of an embodiment of a leg connector of the present invention.
Figure 9B:
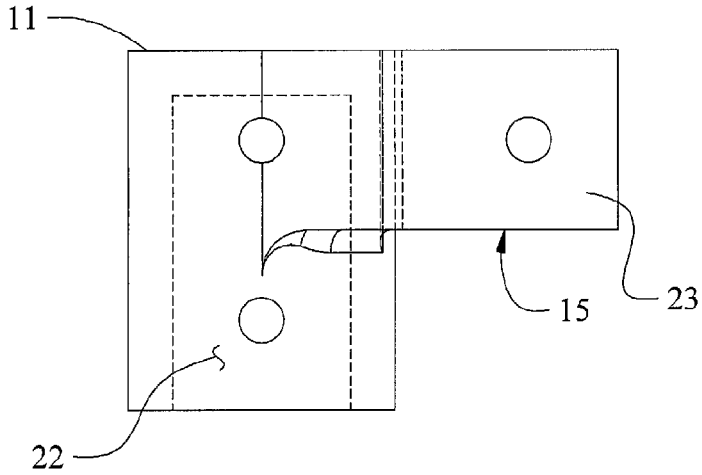
FIG. 9B is a side cross-section view of an embodiment of a leg connector of the present invention.

As shown in FIGS. 9, 9A and 9B, each leg connector 11 comprises an arm bracket 15 and a leg bracket 22. In one embodiment, it is preferred that the leg 7 and the leg connector 11 remain rigid relative to one another when the canopy structure is in the deployed state. Such rigidity preferably is achieved by inserting the end of the upper section 2 of a leg 7 into the leg bracket 22 of the leg connector 11 fastening together, for example, as shown in FIG. 3, by a fastener such as at least one rivet 17 or the like, preferably two rivets 17. Thus, as shown in FIGS. 3, 9, 9A, and 9B, the leg bracket 22 is an orifice or opening complementary in shape to the end of upper section 2 so that the end of the upper section 2 of the leg may be inserted therein and the leg 7 and the leg connector 11 are affixed together by means of the rivets 17.

In one embodiment, it is preferred that an arm 3 and the arm bracket 15 are pivotably connected to one another, whereby the arm may pivot about an axis extending within the arm bracket 15, the pivotable engagement preferably being achieved through a rivet 17, the longitudinal axis of which approximately coincides with the pivot axis, the rivet 17 connecting the arm 3 to the two arm bracket walls 23 of the arm bracket 15, the arm bracket walls 23 sandwiching the end of the outer section of the arm 3.

As shown in FIGS. 3, 8, 8A and 8B, in an embodiment that includes cross arms 6, each cross arm connector 12 may comprise a leg orifice 27 and two cross arm brackets 24. The leg orifice 27 is an opening into which the upper section 2 of the leg 7 extends. Each cross arm bracket 24 preferably is pivotably connected to each of two cross arms 6, whereby each of the cross arms 6 may pivot about an axis within the cross arm bracket, the pivotable engagement preferably being achieved through a rivet 17, the longitudinal axis of which approximately coincides with the pivot axis, the rivet 17 connecting the cross arm 6 and two cross arm bracket walls 25 of the cross arm connector 12, the cross arm bracket walls sandwiching the end of the of the cross arm 6.

If desired, the cross arm connector 12 and the leg connector 11 of each leg may be two portions of a single connecting member. Alternatively, the cross arm connector 12 and the leg connector 11 may be separate elements. In particular, it may be desirable for the upper section 2 of the leg to rotate within the leg orifice 27, wherein no rivets 17 secure the arm 3 to the cross arm connector 12.

Figure 1A:
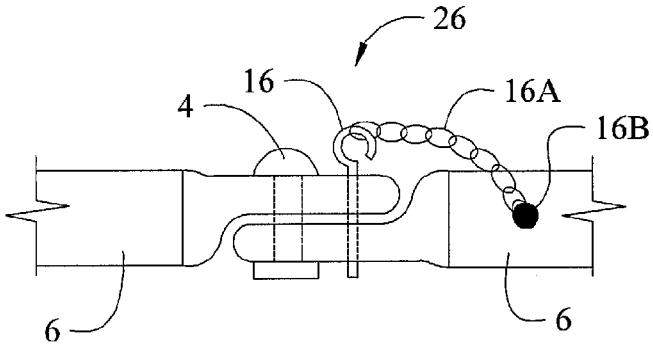
FIG. 1A is a detail view of a portion of an embodiment of a cross arm of the present invention.
Figure 1B:
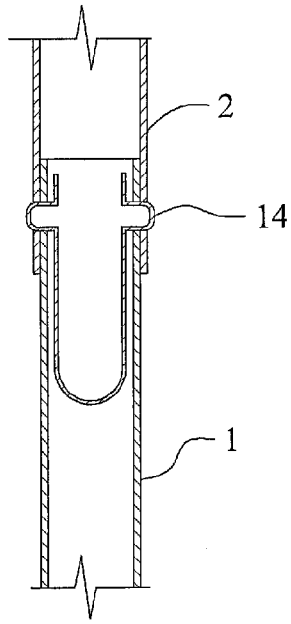
FIG. 1B is a cross-section view of a portion of a leg of the present invention, detailing an embodiment of an internal telescoping mechanism.
Figure 1C:
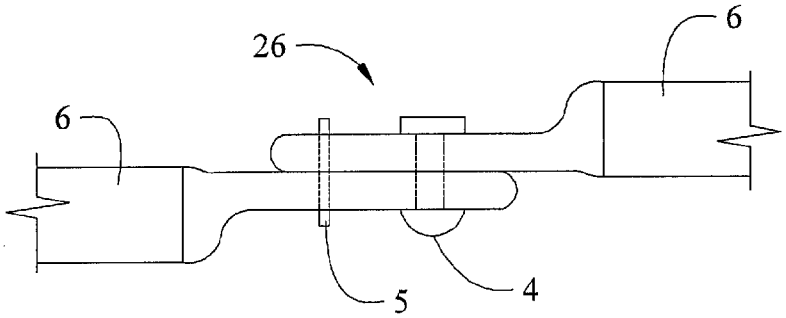
FIG. 1C is a detail view of a portion of an embodiment of a cross arm of the present invention.

As further illustrated in FIGS. 1, 1A and 1C, each cross arm 6 further comprises a cross arm joint 26. The cross arm joint is a mechanism by which the cross arm is pivotably foldable during the collapsing of the frame 8. A cross arm joint 26 and the respective pivotable folding preferably occurs at or near the midpoint between the two opposite ends (or "center") of each cross arm 6. When the canopy structure is erected, the cross arm joint 26 may be secured in a sturdy unfolded position, such that the two connected segments of the cross arm 6 are substantially co-linear and thus the length of the cross arm 6 is substantially linear. Such securing may be accomplished in any manner known to those of ordinary skill in the art, such as through the use of a removable, insertable pin 16 or through the use of a slip ring 5 or washer. Where an insertable pin 16 is used, it may be desirable to have the pin secured to the cross arm 6 by a chain 16A at a chain link point 16B. The cross arm 6 may fold at the cross arm joint 26 around a cross arm rivet 4, or any other device known to those of ordinary skill in the art.

Figure 6:
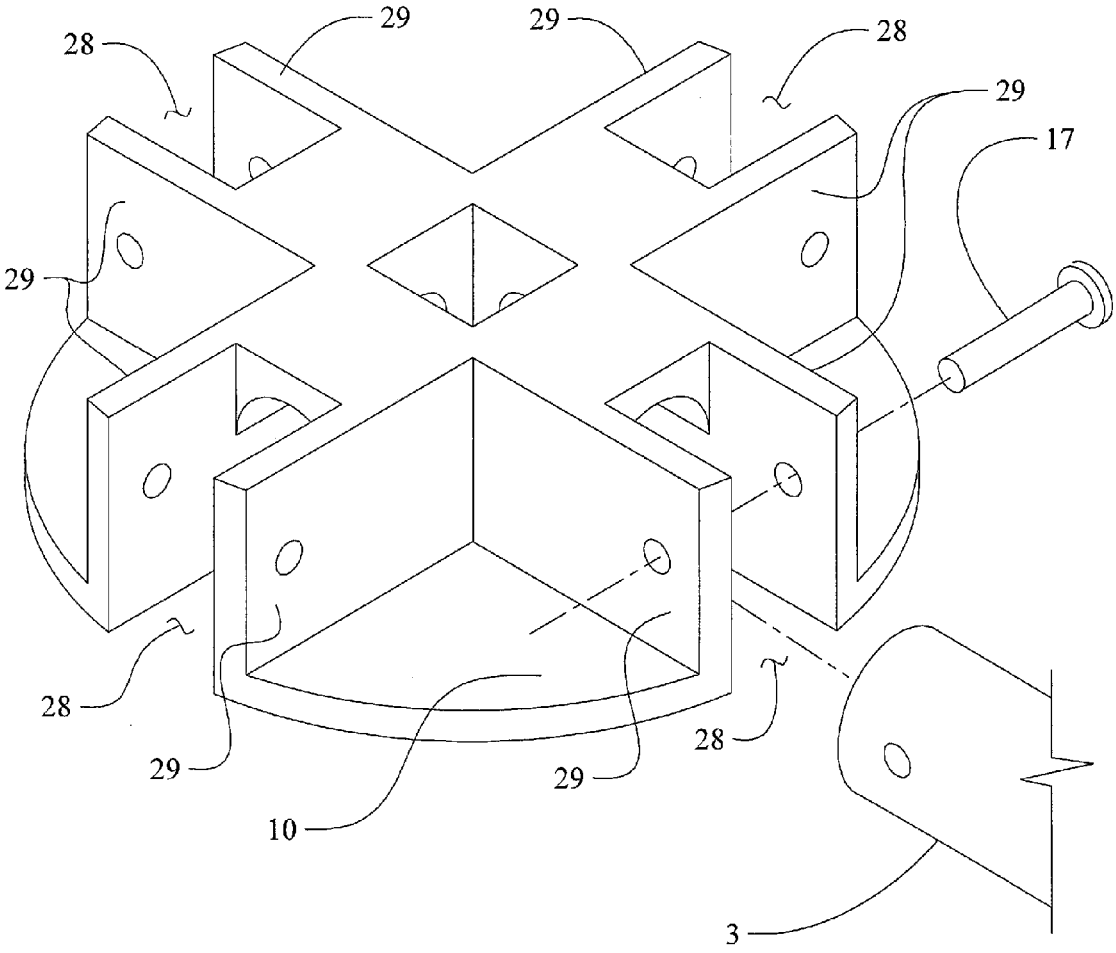
FIG. 6 is a perspective detail view of an embodiment of the hub of the present invention.
Figure 6A:
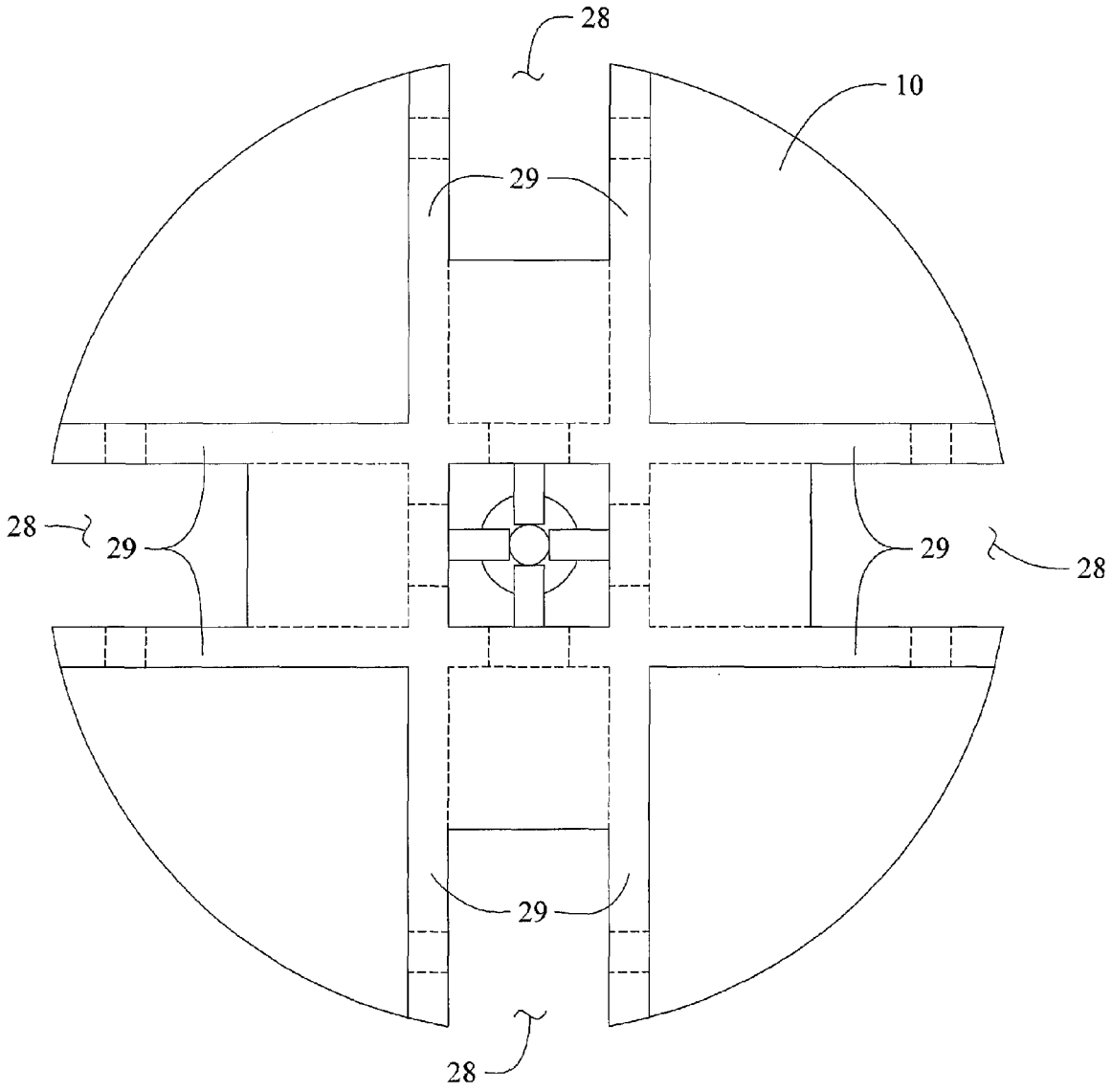
FIG. 6A is a top detail view of an embodiment of the hub of the present invention.
Figure 7:
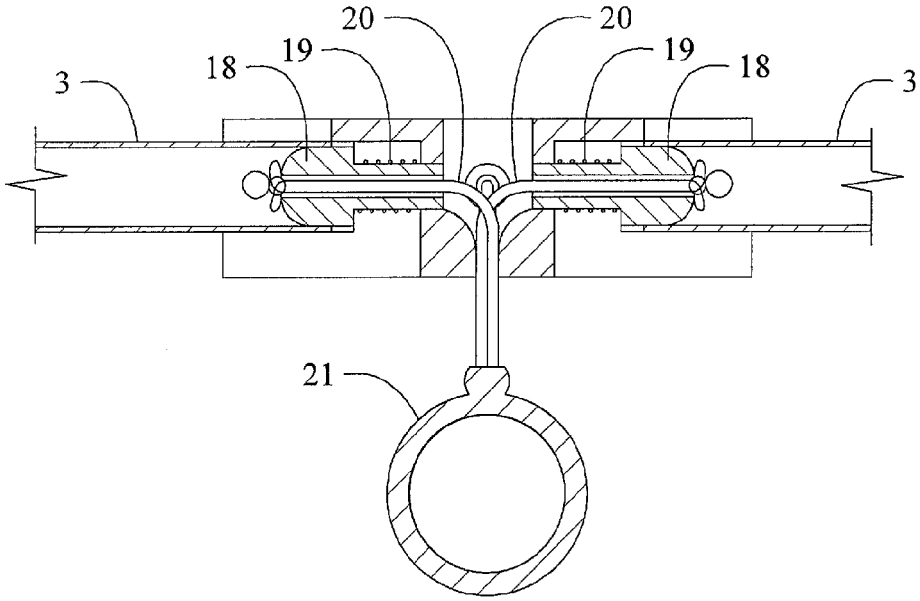
FIG. 7 is a cross-section view of an embodiment of the hub of the present invention, showing the arms in a locked position.
Figure 7A:
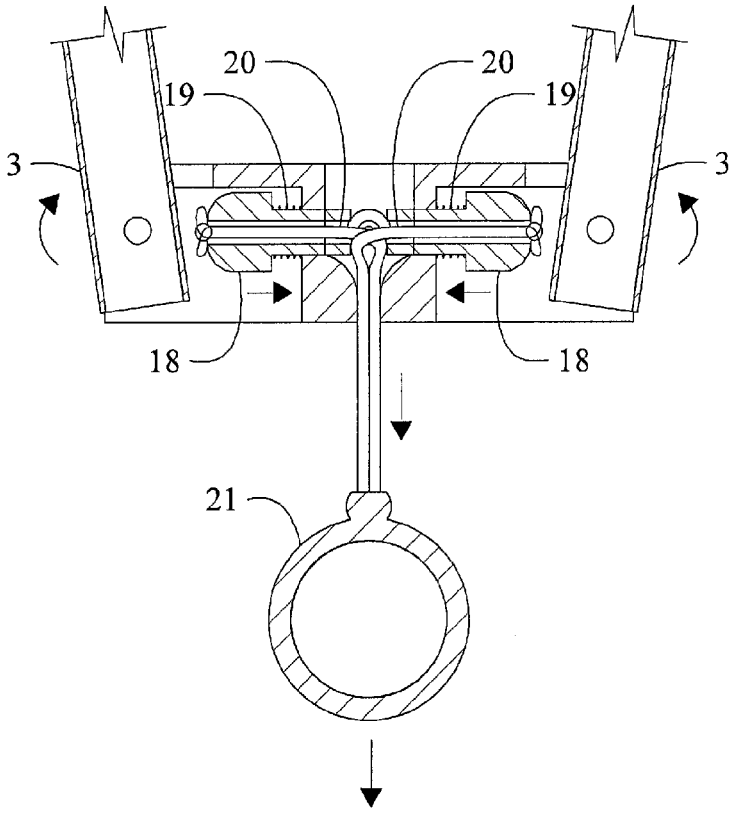
FIG. 7A is a cross-section view of an embodiment of the hub of the present invention, showing the arms in an unlocked position.
Figure 7B:
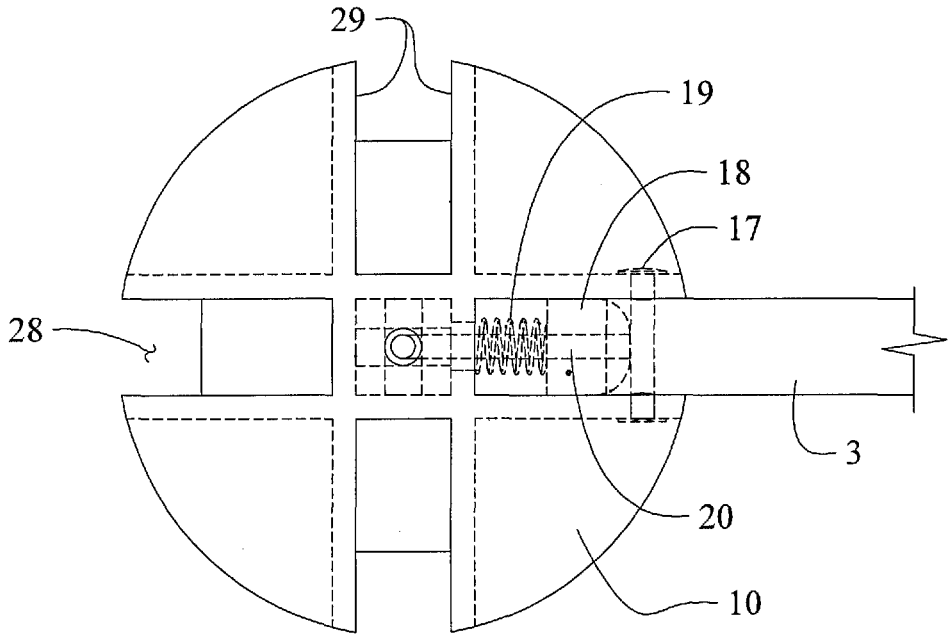
FIG. 7B is a top detail view of an embodiment of the hub of the present invention, detailing an embodiment of an arm locking mechanism.
Figure 7C:
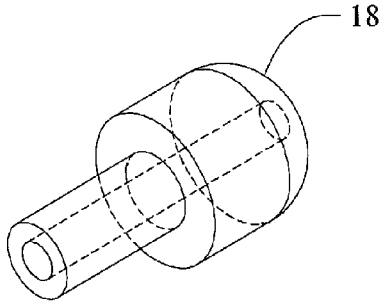
FIG. 7C is a detail view of an embodiment of a locking pin, a part of an embodiment of an arm locking mechanism of the present invention.
Figure 7D:
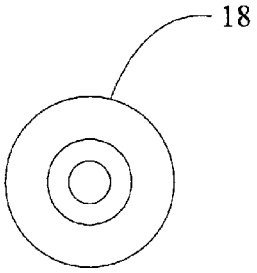
FIG. 7D is a detail end view of an embodiment of a locking pin, a part of an embodiment of an arm locking mechanism of the present invention.
Figure 7E:
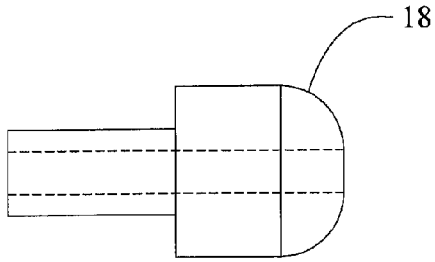
FIG. 7E is a side cross-section view of an embodiment of a locking pin, a part of an embodiment of an arm locking mechanism of the present invention.
Figure 7F:
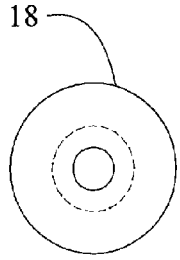
FIG. 7F is a end cross-section view of an embodiment of a locking pin, a part of an embodiment of an arm locking mechanism of the present invention.
Figure 8:
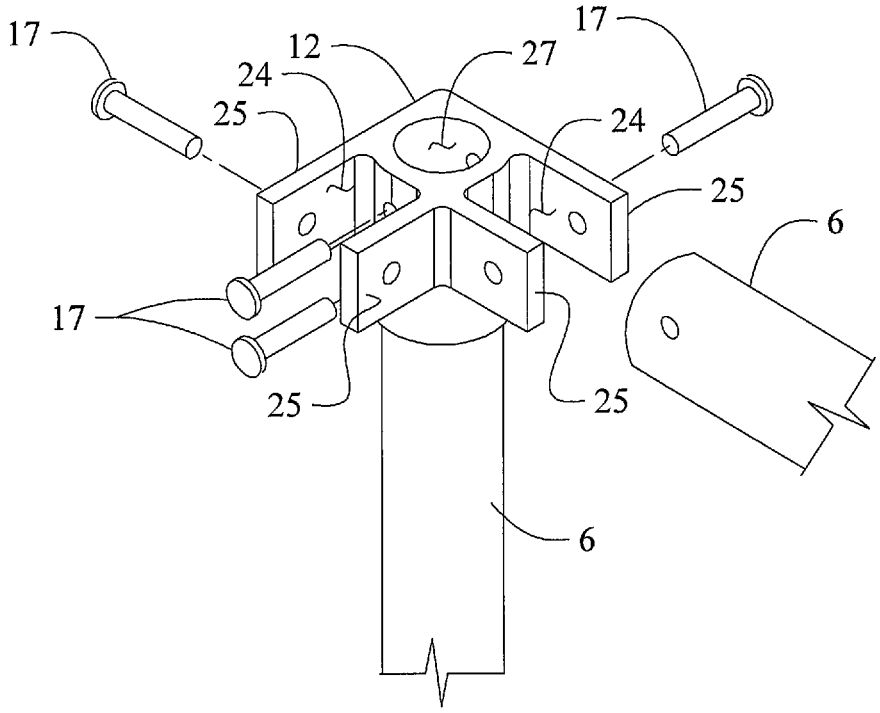
FIG. 8 is a detail perspective view of an embodiment of a cross arm connector of the present invention.
Figure 8A:
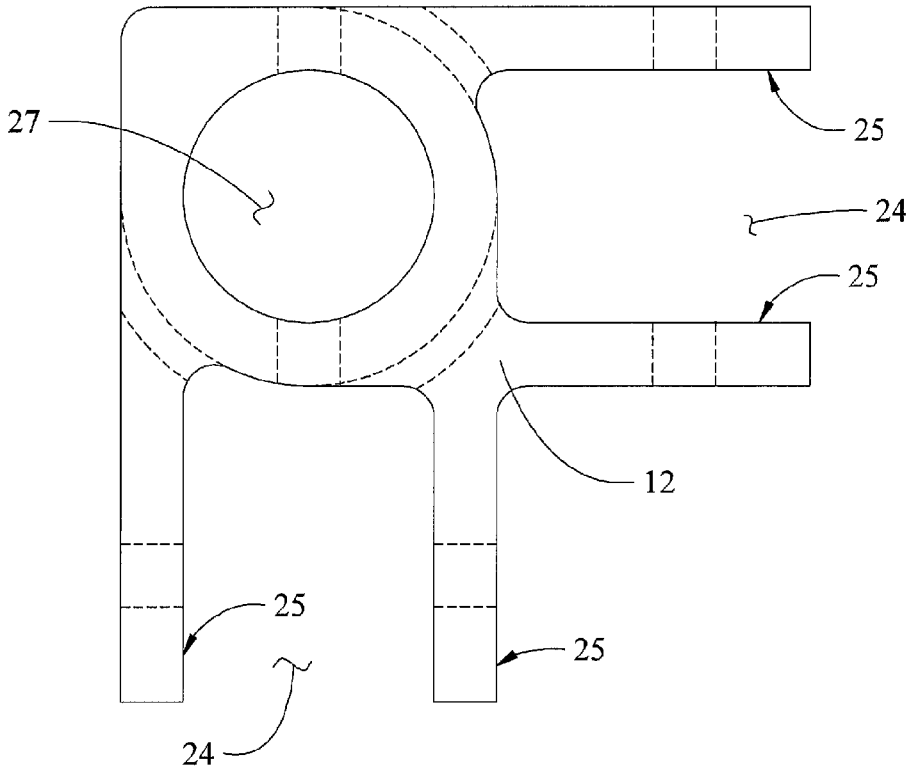
FIG. 8A is a detail top view of an embodiment of a cross arm connector of the present invention.
Figure 8B:
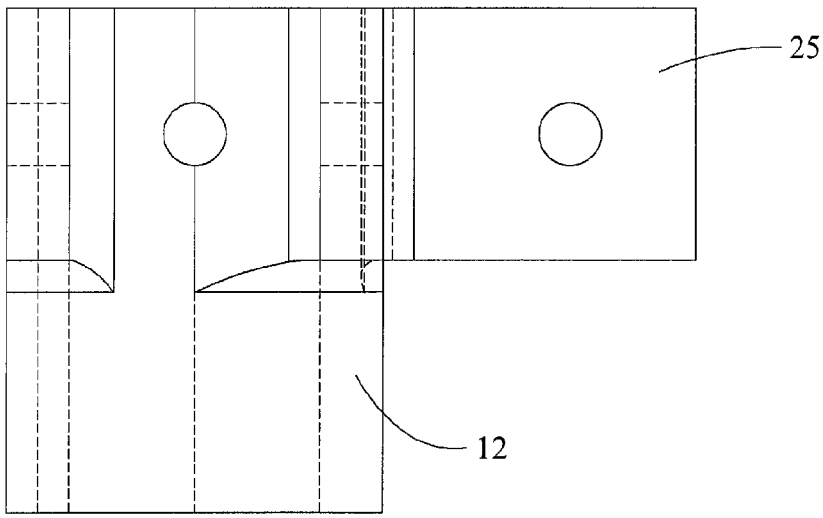
FIG. 8B is a side cross-section view of an embodiment of a cross arm connector of the present invention.

As shown in FIGS. 1D, 6, 6A, 7, 7A and 7B, preferably, the hub 10 comprises a releasable canopy locking mechanism and a plurality of central arm radially-oriented brackets 28 for receiving the ends of the arms 3 in pivotable engagement with the brackets 28 via rivets 17 that pivotably connect the arm 3 and two respective central arm bracket walls 29, with the end of the arm 3 being sandwiched therebetween (see FIG. 6). The canopy locking mechanism allows simple and efficient selective locking and unlocking of the arms 3 in radially outwardly extending, generally co-planar orientation relative to the hub 10. This locking and unlocking preferably occurs in concert with respect to all arms 3. In one embodiment, illustrated in FIGS. 7, 7A, and 7B the releasable canopy locking mechanism comprises a handle such as a ring 21 (shown in FIGS. 7 and 7A as a cross-section), a cable 20, a bias such as a coil spring, shown as spring 19, and a releasable lock such as a locking pin 18 that is reciprocable through a complementary cylindrical opening in the hub 10 between a radially inward position and a radially outward position. FIGS. 7C, 7D, 7E and 7F show an embodiment of a suitable locking pin 18 of the present invention. The ring 21 rests outside of and below the hub 10 when the canopy structure is deployed and is connected to a plurality of locking pins 18, one locking pin 18 for each arm 3 of the frame 8, by means of the cable 20. The locking pins 18 are located substantially within the structure of the hub 10. In this embodiment, each locking pin 18 is biased by a respective spring 19 radially outwardly, away from the center of the hub 10, and into a hollow opening at the end of the inner section of the arm 3, so as to lock the arms 3 into place so that they extend radially outwardly extending, generally co-planar orientation relative to the hub 10 and provide stable support in that position for each arm 3 relative to the hub 10. In operation, to at least partially collapse an erected canopy structure, the user may pull down on the ring 21, whereby the cable 20 pulls each locking pin 18 radially inwardly against the bias of the spring 19 and toward the center of the hub 10. This movement of the locking pins 18 is sufficient to withdraw them each from hollow openings at the ends of the inner sections of the respective arms 3, releasing the arms 3 to permit pivoting of each of the arms 3 about a respective axis within the hub 10. Such pivoting permits the folding of the arms 3 into generally parallel positions with respect to each other. It is preferred that the central arm brackets 28 be angled symmetrically about the hub 10 so that when the canopy structure is fully erected, the angles between each arm 3 and each adjacent arm 3 are substantially equal throughout the canopy structure.

Figure 1D:
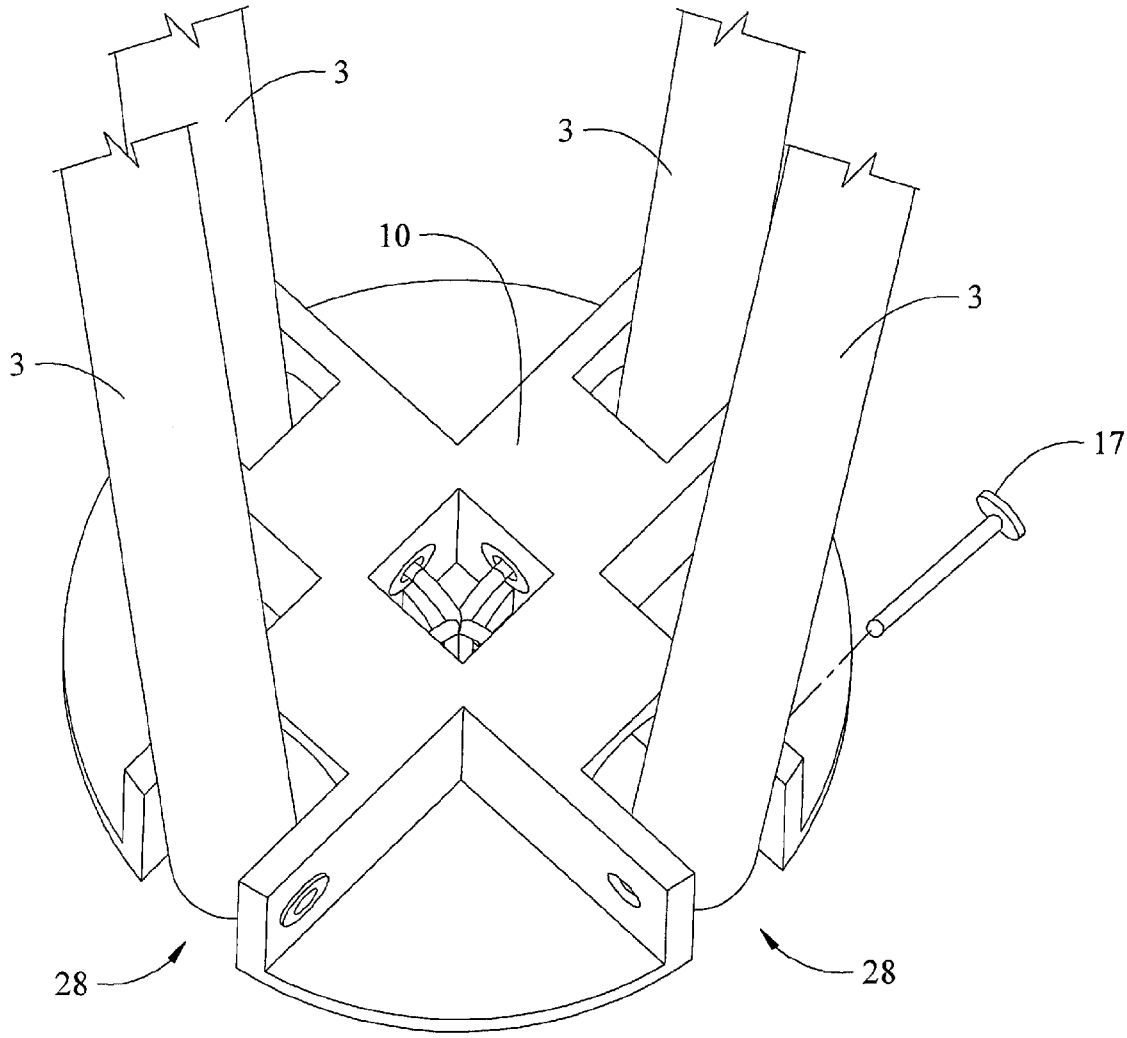
FIG. 1D is a perspective partial detail view of an embodiment of the hub of the present invention, where the arms have been at least partially collapsed.

FIG. 1D shows an embodiment of a portion of the frame 8, specifically the hub 10 of the present invention, where the arms 3 have been at least partially collapsed. FIG. 1D further shows a pin 17 that, when inserted into and through a respective central arm bracket 28, provides the axis around which the arm 3 pivots.

Figure 4:
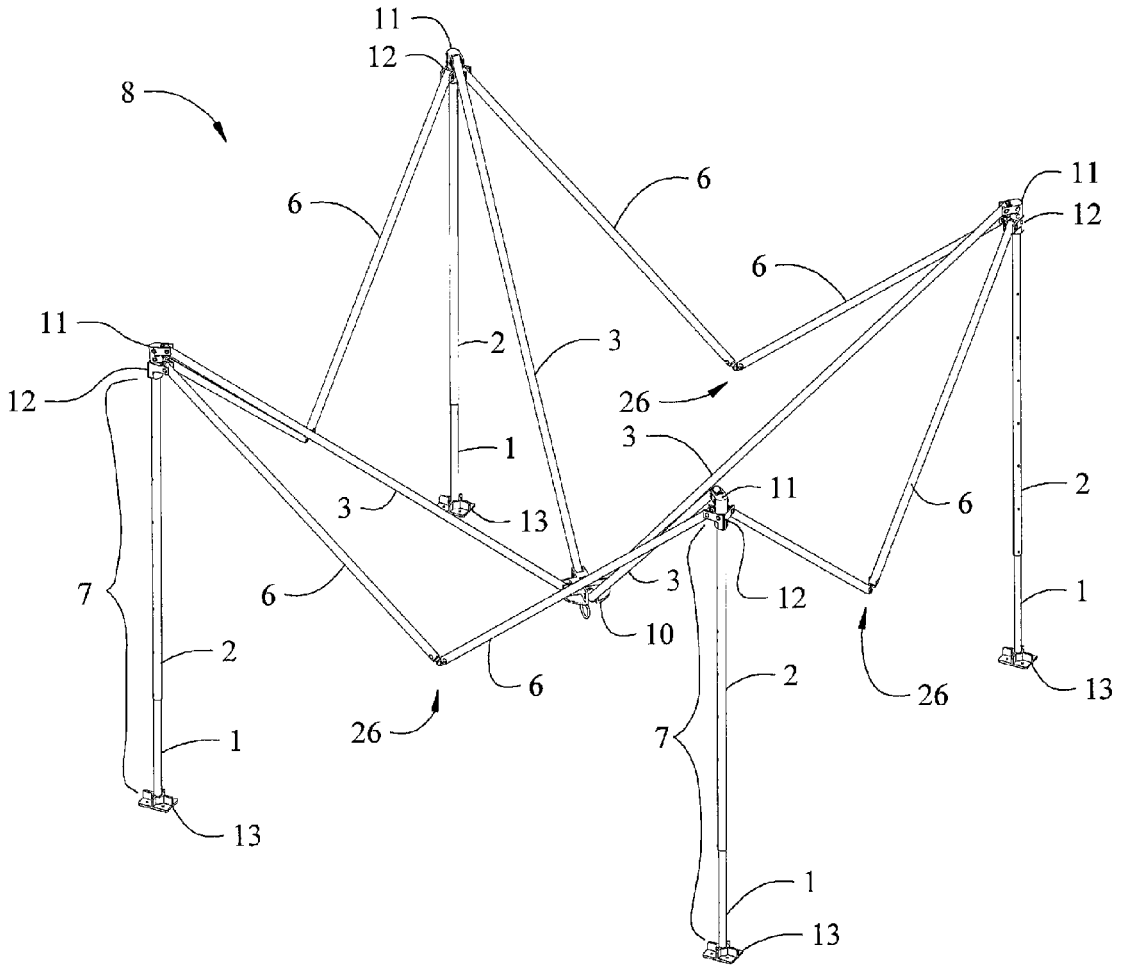
FIG. 4 is a perspective view of an embodiment of a frame of the present invention, detailing a frame that is in a transition state between being fully erected and fully collapsed.
Figure 5:
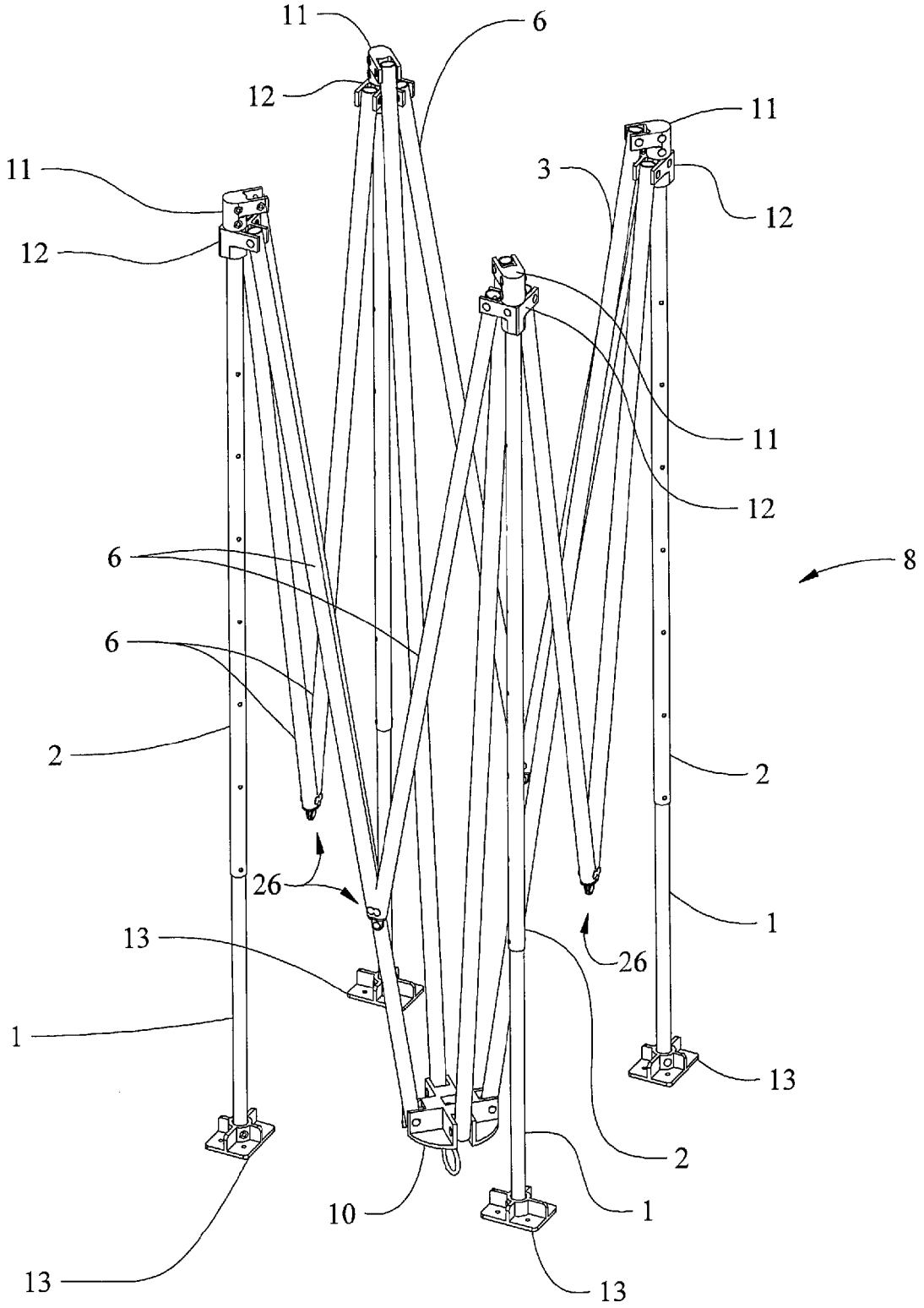
FIG. 5 is a perspective view of an embodiment of a frame of the present invention, detailing a frame that is substantially collapsed.

FIGS. 4 and 5 show an embodiment of a frame of the present invention, in various stages of folding. FIG. 4 shows a frame 8 in a transition state between being fully erected and fully collapsed, this particular frame having the legs 7 at least partially telescoped such that the lower section 1 of each leg is at least partially withdrawn into the respective upper section 2 of the leg. Similarly, FIG. 5 shows an embodiment of a frame of the present invention, detailing a frame that is substantially collapsed.

Figure 2:
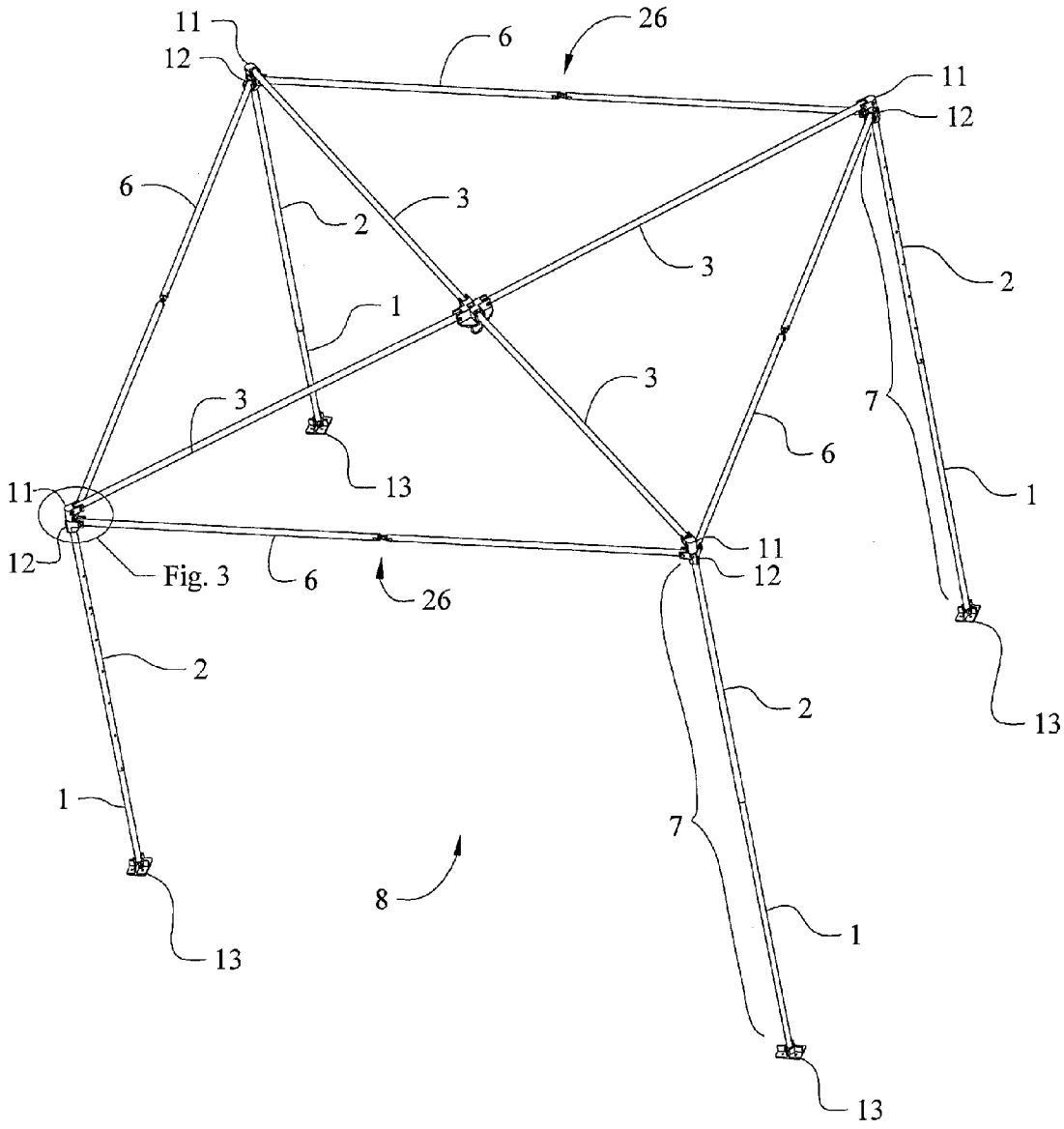
FIG. 2 is a perspective view of an embodiment of a fully erected frame of the present invention, detailing an embodiment of a tilted frame.

In an embodiment, the user may adjust the angle of the top of the canopy frame by adjusting the telescope configurations of at least one leg 7. In operation, where the top of the canopy structure is rectangular, the user may determine the desired approximate angle relative to the ground that the top of the canopy structure should be adjusted to, and further the user may determine the desired direction in which the slope of the top of the canopy structure should be oriented. Upon making these determinations, the user may proceed to the side of the canopy structure that he desires to raise or lower and adjust the legs 7 accordingly. If the user desires a steep slope of the top of the canopy structure, he may choose to telescope the legs 7 in such a manner as to reduce the overall height of the legs by a more severe measurement than if a lesser steeped slope was desired. FIG. 2 shows a frame 8 where two adjacent legs 7 have been telescoped to lengths shorter than the other two legs 7. Similarly, the user may adjust the legs 7 to raise or lower the entire top of the frame or to accommodate variations in the height of the ground under the various legs. Because of the independent pivotable adjustability of the arms and, if present, cross arms, connected to the legs, the structure of the frame enables easy adjustment of one leg at a time, therefore facilitating adjustment by a single user.

Preferably, the user can operate the leg connectors 11, the hub 10 and the cross arm joints 26 in concert, to enable the canopy structure to be erected for use or collapsed so as to be stored or carried. Even more preferably, the user can operate the hub 10 to enable the canopy structure to be erected for use or collapsed so as to be stored or carried.

A canopy is preferably securely attached to the top of the frame 8, and is sized and shaped to shroud the frame, although the canopy can be removed for cleaning, repair, replacement or the like. Preferably, the canopy consists essentially of a thin, flexible material, such as a textile, a water-resistant coated textile, or a flexible plastic sheet, capable of transitioning between a collapsed and erected state. It is preferred that the canopy be substantially waterproof. It is preferred that the canopy provide substantial protection from ultraviolet sunlight.

In one embodiment, all of the legs 7 are telescopic legs. In another embodiment, however, the frame comprises four legs 7, with two adjacent legs 7 identical fixed lengths and the other two legs telescopic. In that or another embodiment, the telescopic legs may each further comprise an internal telescoping locking and adjustment mechanism 14, as shown in FIG. 1B. It is preferred that, if a leg 7 is telescopic, the lower section 1 of the leg telescopes into the upper section 2 of the leg, and the secure position of the upper and lower sections of the leg relative to one another is achieved through an internal telescoping locking and adjustment mechanism 14, such as an internal U-spring, or other mechanisms know by those of ordinary skill in the art.

Figure 13:
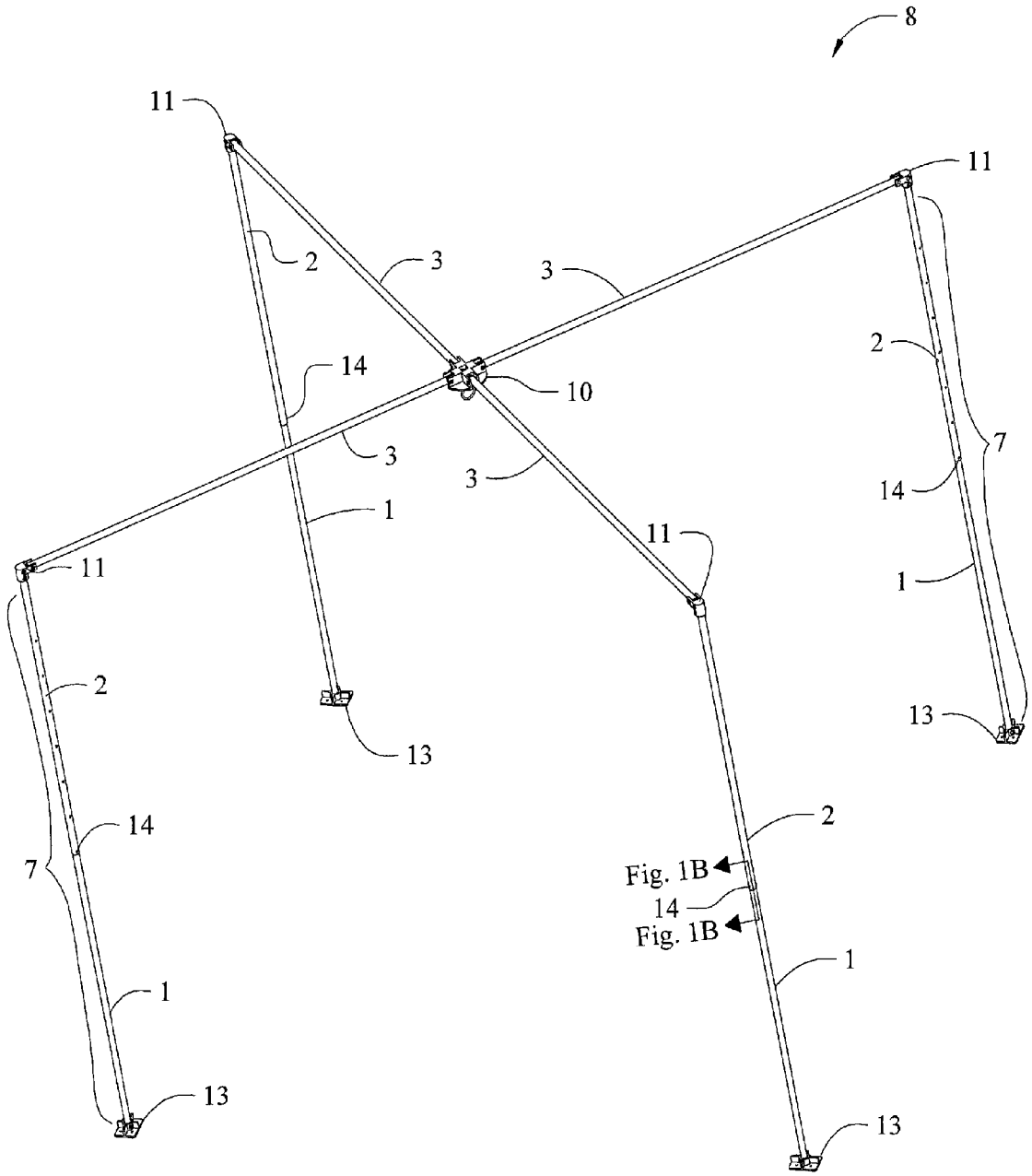
FIG. 13 is a perspective view of a fully erected embodiment of the frame of the present invention, showing a frame without any cross arms or cross arm connectors.

In an embodiment, no cross arms 6 or cross arm connectors 12 are present. Such an embodiment can be seen in FIG. 13, where the frame 8 comprises four legs 7 and four arms 3, where the polygon defined by the leg connectors 11 as vertices is a square. In this embodiment, it is preferred that each of the leg connectors 11 comprises an adjustable locking mechanism that preferably resides within the arm bracket walls 23 of each leg connector 11 and provides adjustable, though stable, support about the rivet 17.

Figure 9C:
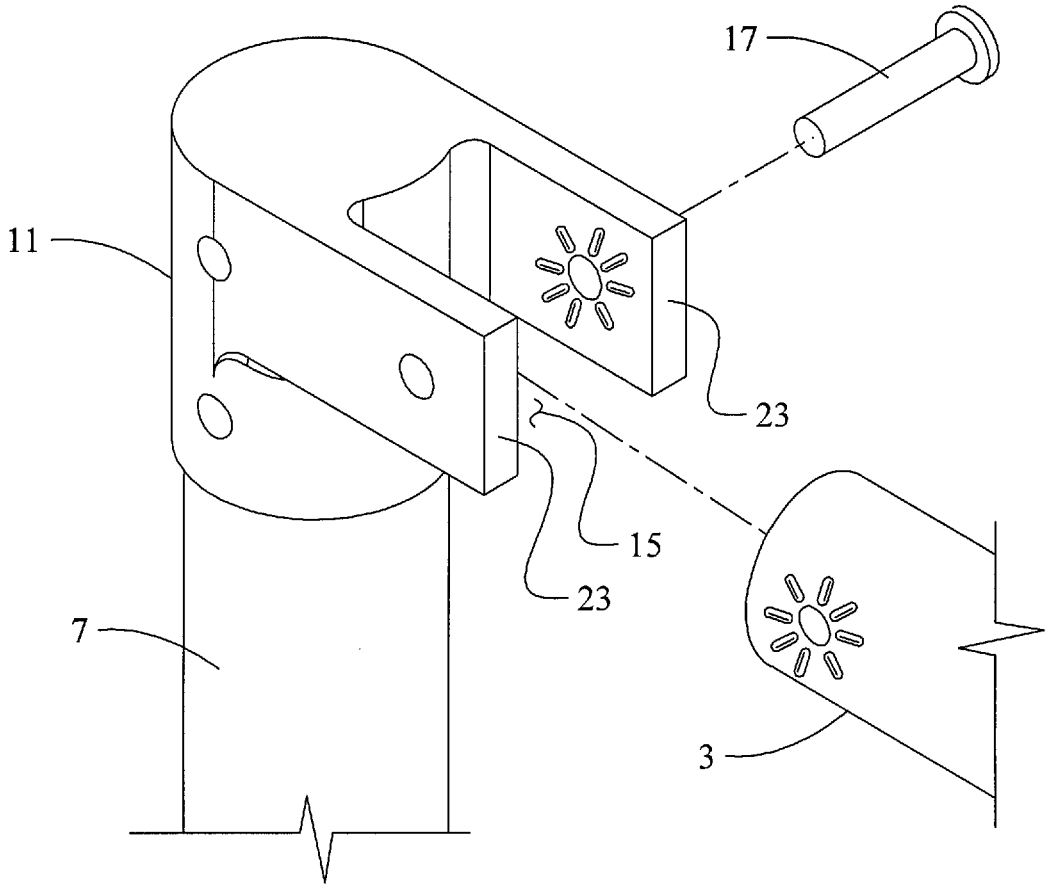
FIG. 9C is a detail perspective view of an embodiment of an adjustable locking mechanism on an arm and respective leg connector.

The aforementioned adjustable locking mechanism may be used to change the angle between both the leg 7 and leg connector 11 with respect to the top of the frame. A user may, in this embodiment, where four legs 7 are present, change the angle of the canopy relative to the legs 7 by adjusting each of the four leg connectors 11 at the respective adjustable locking mechanisms independently of one another and further by adjusting the telescope configurations of two adjacent legs 7. Thus each arm 3 may be pivoted by the user about the rivet 17 from one stable position with respect to the leg 7 and leg connector 11 to another stable position. The adjustable locking mechanism employed in conjunction with the leg connectors 11 in the embodiment of the frame 8 where no cross arms 6 or cross arm connectors 12 are present may be of any suitable variety. In an embodiment, a mechanism may reside in part within the arm bracket walls 23 of each leg connector 11. The mechanism may be a click-type mechanism, as seen in FIG. 9C, comprising a series of raised ribs positioned radially around and extending outwardly from the rivet 17 on one or more arm bracket wall 23 of each leg connector 11, as well as complementary ribs on the outer end of each arm 3. In this manner, a given arm 3 remains substantially rigid about the rivet 17 with respect to its respective leg connector 11 until a user applies force to the leg, arm or both to disengage the click mechanism from one fixed position to another.

In another embodiment of the present invention, where no cross arms 6 or cross arm connectors 12 are present, the top of the frame is triangular in shape when viewed from above. In this embodiment, it is preferred that each of the leg connectors 11 comprises an adjustable locking mechanism that provides adjustable, rigid support between the arm and the leg connector. The aforementioned adjustable locking mechanism may be adjustably altered so as to change the angle between the leg 7 and the top of the frame. Such an adjustable locking mechanism may be of any type known to those of ordinary skill in the art. A user may, in this embodiment, where three legs 7 are present, change the angle of the canopy by adjusting each of the three leg connectors 11 at the respective adjustable locking mechanisms and further by adjusting the telescope configurations of either two adjacent legs 7 or one leg.

In an embodiment of the present invention, the hub 10 further comprises a raised protrusion on a top surface of the hub, whereby the raised protrusion results in a top canopy surface that is not planar. This configuration is especially useful for use outside where it may rain, when the rainwater would not pool on the top of the canopy, but rather run off the sides of the canopy.

The arms 3 and legs 7, and the cross arms 6, when present, are all preferably made of substantially the same material, that material preferably being a lightweight, sturdy rigid material that can withstand substantial outdoor use and exposure to the elements. Aluminum is a preferred material, but other materials, such as rigid PVC may be employed.

As can be seen in FIGS. 11A-D, a series of four schematic diagrams is provided, each showing a side view of a portion of an embodiment of the frame of the present invention. These diagrams show a rear leg fixed at seven feet in height 501, the top of the canopy fixed at five feet in length 503, and a front leg variable in height from seven feet to four feet 502. Further, these diagrams show the distance 504 between the variable front leg 503 and the fixed back leg 501, as well as the angle 505 between the top of the canopy 503 and the fixed rear leg 501. In each of FIGS. 11A-D, the top of the canopy 505 can be sloped relative to the horizontal and relative to the fixed back leg 501.

Figure 11A:
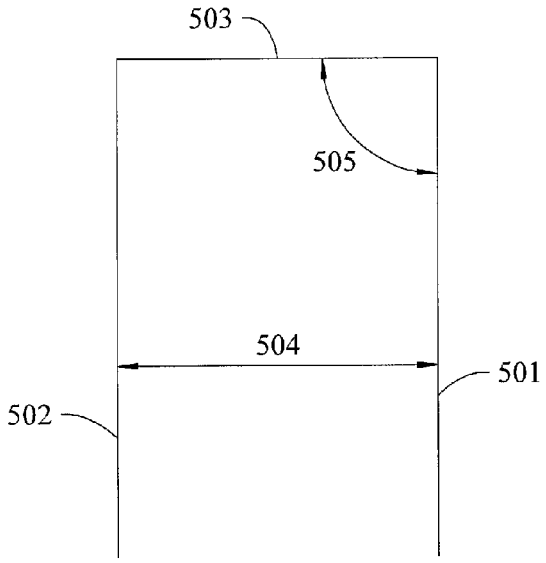
FIG. 11A is a schematic diagram representing a side view of a portion of an embodiment of the frame of the present invention, this diagram showing the angle between the top of the canopy and the rear leg and the distance front leg and the back leg, when the front leg is at a first height.

In the example of FIG. 11A, where the variable front leg 502 is 7 feet in height, the angle 505 between the top of the canopy 503 and the rear leg 501 is 90 degrees and the distance 504 between the variable front leg 503 and the fixed back leg 501 is 5 feet.

Figure 11B:
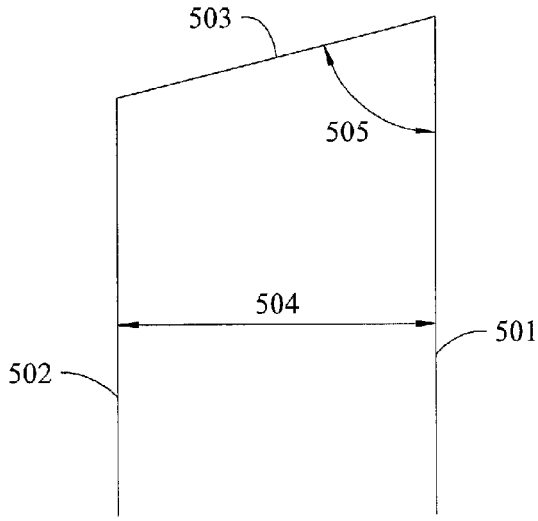
FIG. 11B is a schematic diagram representing a side view of a portion of an embodiment of the frame of the present invention, this diagram showing the angle between the top of the canopy and the rear leg and the distance front leg and the back leg, when the front leg is at a second height.

In the example of FIG. 11B, where the variable front leg 502 is 6 feet in height, the angle 505 between the top of the canopy 503 and the rear leg 501 is approximately 76 degrees and the distance 504 between the variable front leg 503 and the fixed back leg 501 is approximately 4.95 feet.

Figure 11C:
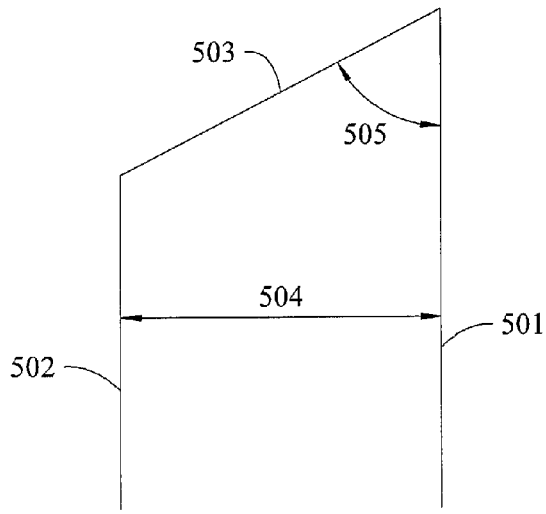
FIG. 11C is a schematic diagram representing a side view of a portion of an embodiment of the frame of the present invention, this diagram showing the angle between the top of the canopy and the rear leg and the distance front leg and the back leg, when the front leg is at a third height.

In the example of FIG. 11C, where the variable front leg 502 is 5 feet in height, the angle 505 between the top of the canopy 503 and the rear leg 501 is approximately 63 degrees and the distance 504 between the variable front leg 503 and the fixed back leg 501 is approximately 4.6 feet.

Figure 11D:
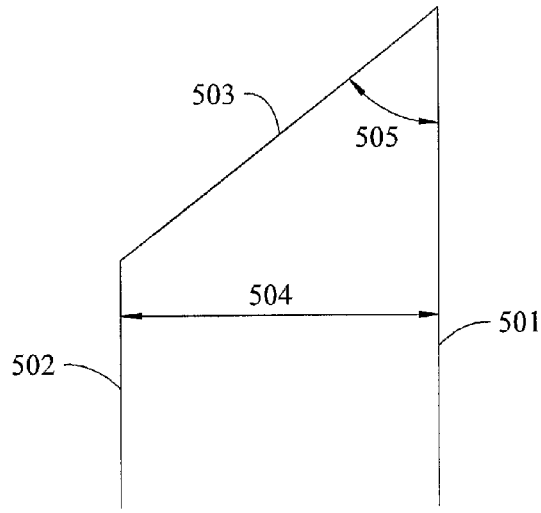
FIG. 11D is a schematic diagram representing a side view of a portion of an embodiment of the frame of the present invention, this diagram showing the angle between the top of the canopy and the rear leg and the distance front leg and the back leg, when the front leg is at a fourth height.

In the example of FIG. 11D, where the variable front leg 502 is 4 feet in height, the angle 505 between the top of the canopy 503 and the rear leg 501 is approximately 52 degrees and the distance 504 between the variable front leg 503 and the fixed back leg 501 is approximately 4 feet.

In this manner, as can be readily seen from the figures and the description herein, the heights of the legs may be adjusted independently or in concert, as desired. For example in a four-legged embodiment, two adjacent legs may be adjusted to a variety of heights, while the heights of the remaining two legs remain unaltered, allowing the slope of the top of the canopy relative to the rear legs to vary, all the while keeping the legs substantially parallel to one another while the canopy rests on a flat surface.

As can be seen in FIG. 12, the present invention includes a frame with a canopy 101 attached thereto. The canopy may be constructed of any suitable material known in the art, and may be attached to the frame in any manner known in the art, such as through the use of a rivet and grommet. The canopy may also be removable for cleaning or replacement. Preferably, the canopy is constructed of a waterproof or water resistant material and provides at least some filtering of ultraviolet light.

It should be understood that the aforementioned embodiments are for exemplary purposes only and are merely illustrative of the many possible specific embodiments that can represent applications of the principles of the invention. For the purposes of example only, it should now be understood that the canopy can be three-sided, i.e., triangular, or circular or any other desired shape suitable for use with the canopy structure of the present invention. Furthermore, it should now be understood by one of ordinary skill in the art how to adapt the canopy structure, if needed, to a selected canopy shape using the present invention.

Without departing from the spirit and scope of this invention, one of ordinary skill in the art can make various changes and modifications to the invention to adapt it to various usages and conditions, including those not specifically laid out herein. As such, those changes and modifications are properly, equitably, and intended to be, within the full range and scope of equivalents of the invention disclosed and described herein.

I claim:

1. A canopy frame comprising:

a hub:

four arms, each arm having a length with opposite inner and outer ends, the inner end of each arm being pivotally connected to the hub with the four anus extending outwardly from the hub and having a generally coplanar orientation relative to the hub;

four legs, each leg having a length with opposite upper and lower sections, the upper section of each leg being pivotally connected to an outer end of one arm of the four arms;

four cross arms, each cross arm having opposite ends that are pivotally connected between adjacent legs of the four legs, the four cross arms being coplanar and being parallel with the four arms; and, the four legs being substantially parallel.

2. The canopy frame of claim 1, further comprising:

each cross arm of the four cross arms having a pivot connection in the cross arm between the opposite ends of the cross arm.

3. A canopy frame comprising:

a hub:

four arms, each arm having a length with opposite inner and outer ends, the inner end of each arm being pivotally connected to the hub with the four arms extending outwardly from the hub and having a generally coplanar orientation relative to the hub;

four legs, each leg having a length with opposite upper and lower sections, the upper section of each leg being pivotally connected to an outer end of one arm of the four arms;

four cross arms, each cross arm having opposite ends that are pivotally connected between adjacent legs of the four legs, the four cross arms being coplanar and being parallel with the four arms; and, the four legs including a first pair of adjacent legs and a second pair of adjacent legs, the first pair of legs having lengths that are adjustable relative to the lengths of the second pair of legs where with the first and second pairs of legs being substantially parallel, when the first pair of legs lengths are adjusted to be shorter than the second pair of legs lengths the first pair of legs and the pair of arms that are pivotally connected to the first pair of legs are oriented at an angle that is larger than 90° while the second pair of legs and the pair of arms that are pivotally connected to the second pair of legs are oriented at an angle that is smaller than 90°.

4. A canopy frame comprising:

a hub:

four arms, each arm having a length with opposite inner and outer ends, the inner end of each arm being pivotally connected to the hub with the four arms extending outwardly from the hub and having a generally coplanar orientation relative to the hub;

four legs, each leg having a length with opposite upper and lower sections, the upper section of each leg being pivotally connected to an outer end of one arm of the four arms;

four cross arms, each cross arm having opposite ends that are pivotally connected between adjacent legs of the four legs, the four cross arms being coplanar and being parallel with the four arms; and, with the first pair of legs adjusted to a length that is the same length as the second pair of legs, the first pair of legs and the pair of arms pivotally connected to the first pair of legs are oriented at a 90° angle while the second pair of legs and the pair of arms pivotally connected to the second pair of legs are oriented at a 90° angle.

* * * * *